United States Patent [19]

Nurk

[11] 4,100,769

[45] Jul. 18, 1978

[54] CIRCULAR KNITTING MACHINE METHOD FOR MANUFACTURING ONE PIECE PANTY HOSE OR THE LIKE

[76] Inventor: Siegfried Nürk, Körnerstrasse 5, 7470 Albstadt 3, Fed. Rep. of Germany

[21] Appl. No.: 683,429

[22] Filed: May 5, 1976

[30] Foreign Application Priority Data

Jan. 15, 1976 [IT] Italy ..... 19300/76

[51] Int. Cl.[2] ..... A41B 9/14; D04B 1/00

[52] U.S. Cl. ..... 66/177; 2/409; 66/14; 66/149.5; 28/154

[58] Field of Search ..... 2/409; 66/177, 14, 149.5; 28/77, 154

[56] References Cited

U.S. PATENT DOCUMENTS

| | | | |
|---|---|---|---|
| 2,511,720 | 6/1950 | Lacks | 66/177 |
| 2,962,884 | 12/1960 | Garrou et al. | 66/177 |
| 3,109,300 | 11/1963 | Garrou et al. | 66/177 |
| 3,109,301 | 11/1963 | Garrou et al. | 66/177 |
| 3,670,529 | 6/1972 | Fregeolle | 66/177 |
| 3,748,870 | 7/1973 | Fregeolle | 66/177 |
| 3,802,229 | 4/1974 | Fregeolle | 66/177 |
| 3,808,842 | 5/1974 | Fisher et al. | 2/409 X |
| 3,815,385 | 6/1924 | Gariboldi | 66/177 X |
| 3,826,111 | 7/1974 | Peberdy | 66/14 |
| 3,841,112 | 10/1974 | Uhlir et al. | 66/149.5 X |
| 3,924,423 | 12/1975 | Lonati | 66/177 X |
| 3,956,909 | 5/1976 | Negri | 66/177 |

FOREIGN PATENT DOCUMENTS

| | | | |
|---|---|---|---|
| 2,032,241 | 11/1970 | France | 66/177 |
| 479,392 | 3/1972 | Japan | 66/177 |
| 1,303,656 | 1/1973 | United Kingdom | 66/177 |

*Primary Examiner*—Mervin Stein
*Assistant Examiner*—Andrew M. Falik
*Attorney, Agent, or Firm*—Lynn L. Augspurger

[57] ABSTRACT

A method for manufacturing panty hose or like fabrics including two leg portions and a panty portion integral therewith, the leg portions being knitted as tubular portions by continuous rotary motion of a needle cylinder or needle cylinders of a circular knitting machine and the panty portion being knitted by reciprocatory motion. Knitting of the panty portion included inactivation of a number of needles, knitting a first part of constant width formed by partial courses defining selvedge edges at their ends, knitting a central part by firstly narrowing and widening like a heel and then newly narrowing and widening, and knitting a second part of constant width formed by partial courses defining selvedge edges at their ends. The fabric is then cut to define the waist opening and the two parts of constant width are sewn together along the corresponding selvedge edges. The machine for carrying out this method comprises means for stretching the fabric during manufacturing of the panty portion, these means including a flexible tubular element at the end of a fabric guide arranged within the needle cylinder through which the fabric is taken up and a suction duct opening in the guide in a position between the flexible tubular element and the needle working region. Suction through the suction duct causes the tubular element to squeeze about the fabric, thus increasing the stretching action on the fabric portion which is knitted.

3 Claims, 10 Drawing Figures

CIRCULAR KNITTING MACHINE METHOD FOR MANUFACTURING ONE PIECE PANTY HOSE OR THE LIKE

BACKGROUND OF THE INVENTION

This invention relates to a method for manufacturing panty hose or the like and a circular knitting machine particularly suitable for carrying out this method.

One limitation of known methods for manufacturing panty hose or the like, formed from two legs and a panty portion, is their unsatisfactory adaptability to the person. In this respect, those methods in which the manufacture is in the form of a tube from one leg to the other have a panty portion of insufficient height and an imperfect adaptation at the crotch, while methods which manufacture the panty portion like a double heel, i.e. with a first half formed by narrowing and widening as by heel manufacturing and a second equivalent half, adapt themselves better to the person but also have height limitations which lead to an unsatisfactory product.

On the other hand, the more traditional manufacture, in which the fabric is formed in two separate halves to be sewn together, has the disadvantage of lengthy sewing of the parts. This disadvantage is the greater, the greater the number of parts to be sewn together, which may also be three or four because of the presence of central gussets. Moreover, the sewing is never carried out on completely straight parts and this makes sewing more difficult because of the difficulty in making the parts mate perfectly at each point.

SUMMARY OF THE INVENTION

One object of the present invention is to provide a method of the type concerned, which overcomes the aforementioned disadvantages and provides panty hose or the like with a height of the panty portion which may be varied at will, and at the same time both reducing and simplifying the sewing operations.

A further object of the present invention is to provide a method which may be carried out equally well on a single cylinder circular knitting machine and on a double cylinder circular knitting machine.

A further object of the present invention is to provide a circular knitting machine particularly suitable for carrying out a method as stated above, which machine although being developed for a new method does not require complicated structural means to be provided and in fact allows the method to be carried out by extremely simple means.

These and further objects, which will be more evident from the description given hereinafter, are attained by a method for manufacturing panty hose or the like on a circular knitting machine having a needle cylinder or two needle cylinders, the method comprising manufacturing a first leg portion with continuous rotary motion of the needle cylinder or needle cylinders and with all the needles operating, inactivating a certain number of needles which are caused to hold the fabric on termination of said leg portion, knitting with the remaining needles by reciprocating the needle cylinder or needle cylinders to form a first part of constant width consisting of partial courses defining a selvedge at their ends, this knitting extending over a predetermined length, progressively reducing the operating needles causing the needles inactivated on the two sides of the group of operating needles to hold the fabric, progressively increasing the operating needles by newly activating the progressively inactivated needles until the same number of operating needles has been attained as during the manufacture of said first part, further reducing and further increasing the operating needles as during said progressively reducing step and said progressively increasing step, manufacturing a second part of constant width substantially equivalent to said first part, said second part extending over substantially the same predetermined height as said first part, simultaneously activating all the needles causing the needle cylinder or needle cylinders to pass into continuous rotary motion and knitting a second leg portion with all the needles, cutting the central part of the fabric to define a waist opening, and sewing said first and second part at the selvedges on the two sides over the entire height of said parts.

A method of this type, in which two open portions extending over any required height are manufactured by reciprocating motion, offers the advantage of being able to vary at will the height of the entire panty portion, so considerably improving the fitting of the panty portion itself. The fitting is also improved by the fact that the open portions may be constructed with a relatively large number of needles, for example three quarters of the total needles of the needle cylinder for each of the two portions, because of which after these portions have been sewn together, the panty portion is much wider than the leg portions each constructed with all the cylinder needles. Sewing is limited to a relatively short length on the front and back of the panty portion and is carried out over straight edges which meet both at their beginning and end, because of which the operation is rapid and simple.

The machine proposed for carrying out the above method is a circular knitting machine having at least one needle cylinder, means for reciprocating said at least one needle cylinder, and selection and programming means for simultaneously and progressively inactivating selected needles and for simultaneously and progressively returning them to operation, the machine further comprising suction means for the fabric and an element for closing the passage of the fabric through said at least one needle cylinder, said element being configured to operate simultaneously with the operation of said suction means.

Advantageously said element consists of a flexible tubular element fixed to the outlet of a guide and discharge tube for the fabric arranged within said at least one needle cylinder, said element being arranged at a distance from the needle working region substantially equal to or less than the length of a leg portion of the fabric to be manufactured, and said suction means comprise a duct opening into said guide and discharge tube between said flexible tubular element and the needle working region, the suction through said means causing the flexible tubular element to simultaneously contract on to the fabric and close the guide tube.

In an embodiment of this type an effective suction action is obtained, which allows regular production of knitted fabric on the side being worked while a determined number of needles holds the fabric on the opposite side, and furthermore the fabric is safeguarded in that it is not held by mechanical means such as grippers or the like. The embodiment according to the invention also leads to considerable simplification of the entire structure. The suction action squeezes the tube on to the fabric, which is then instantaneously released when suction finishes, without any need for intermediate members between the suction means and the closure element.

BRIEF DESCRIPTION OF THE DRAWINGS

Further characteristics and advantages of the invention will be more evident from the detailed description given hereinafter by way of example of a preferred embodiment of the invention illustrated in the accompanying drawings, in which:

FIG. 6, namely parts 6*a* to 6*e*, shows the configuration of the downwardly-extending fabric tube as it hangs from the needle cylinder during the knitting of sections 3–8 as shown in FIG. 1.

DESCRIPTION OF THE PREFERRED EMBODIMENTS

Figures 1, 4:
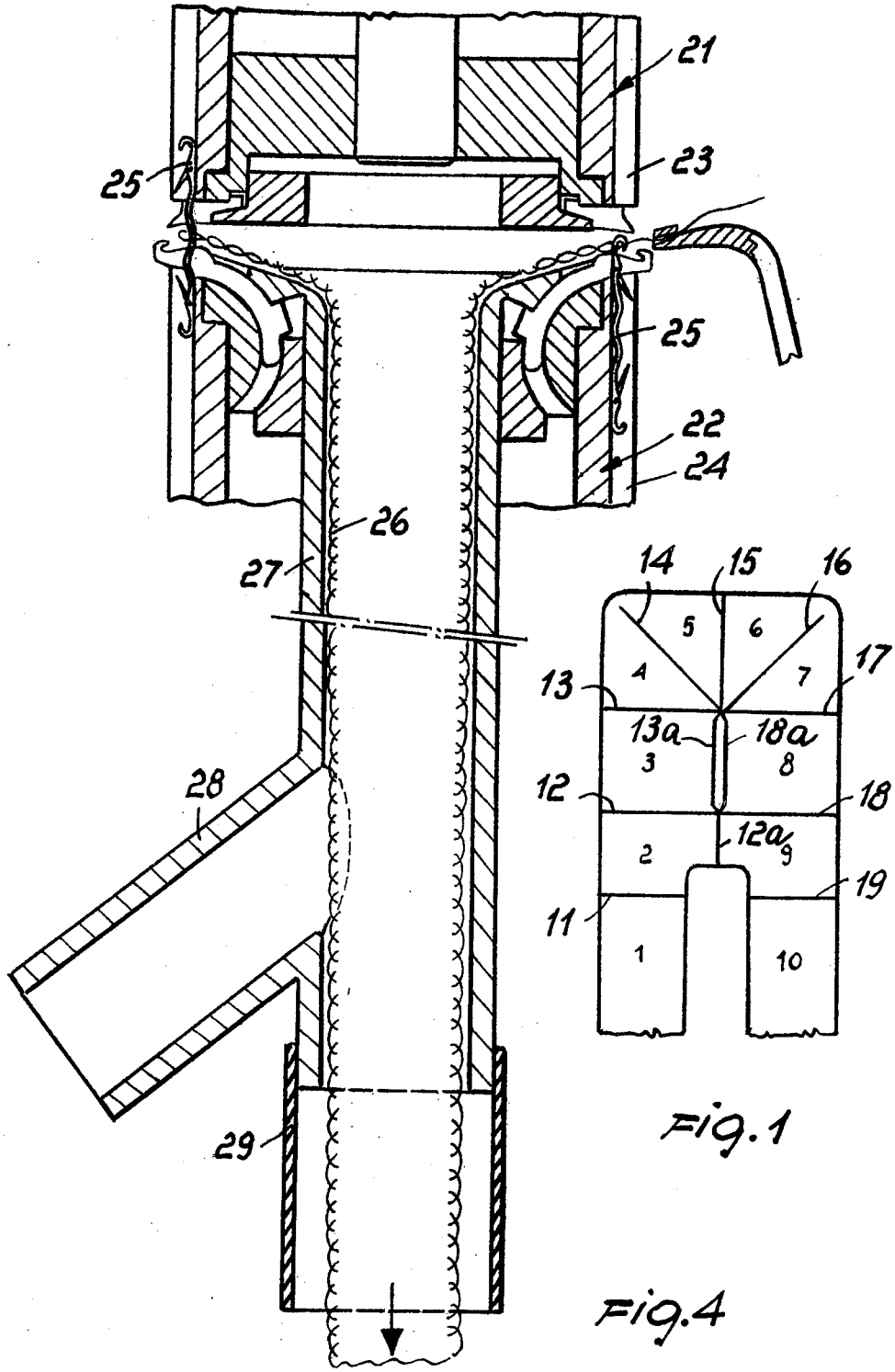
FIG. 1 is a diagrammatic view of a panty hose obtained in accordance with the invention, the various parts being numbered in the same order in which they are obtained.
FIG. 4 is a partial section through a machine according to the invention at the beginning of the manufacture of the panty portion, the machine being shown by way of example as of the double cylinder type.
Figure 2:
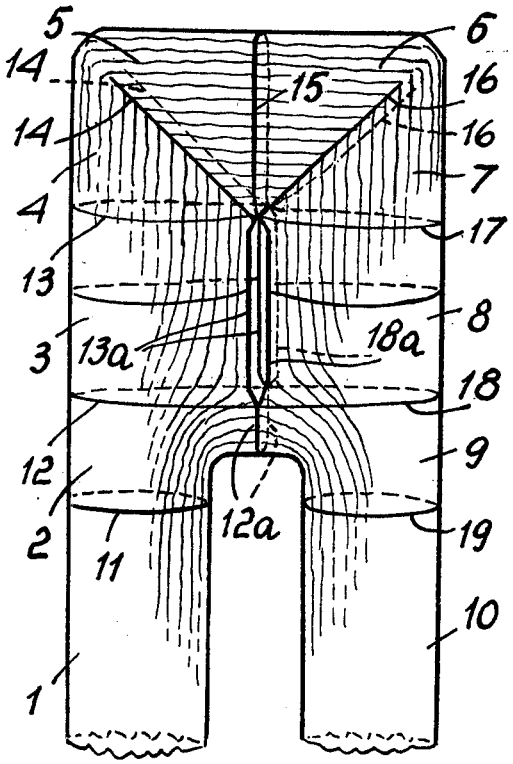
FIG. 2 shows schematically the same panty hose as discharged from the machine, the thin lines illustrating the development of the wales, which extend orthogonally to the courses of knitting.

With reference to FIGS. 1 and 2, the construction of the panty hose according to the invention starts with a first leg portion 1 (of which the figures show only the upper part) in conventional manner with the needle cylinder or needle cylinders rotated continuously and all knitting needles in operation. This operation may proceed identically even beyond the row 11 for the entire length 2, or the thread or type of stitch may be changed for this latter length, for example portion 1 may be rib knitted and portion 2 may be plain knitted, thus resulting wider than portion 1. Portion 2 is knitted while continuing operation with all needles and with the needle cylinder or needle cylinders rotating continuously.

When row 12 is reached, a part of the needles, namely the needles corresponding to the arc 12*a*, which formed part of the last complete course of portion 2, are excluded from operation, the excluded needles being brought to a non-working position while holding the fabric along arc 12*a*. This inactivation is done in the conventional manner by selecting a group of needles. The inactivated needles are held inoperative for the whole manufacturing of the panty portion, which is therefore knitted by a number of needles always less than the total number of needles of the needle cylinder.

Figure 6A:
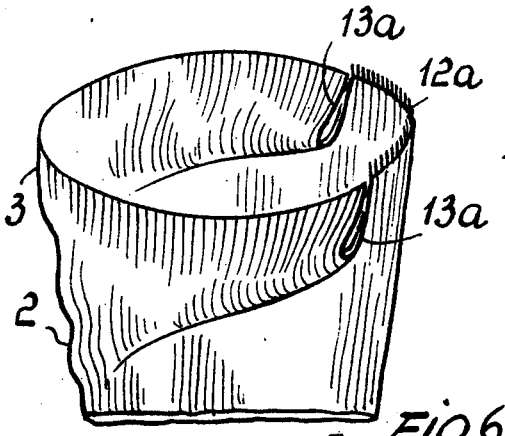
FIGS. 6*a*, 6*b*, 6*c*, 6*d* and 6*e* show schematically the fabric as it hangs down from the needle cylinder during subsequent knitting steps.

At this point the needle cylinder is driven with reciprocating motion through an amplitude at least equal to 360° and advantageously even greater, and the fabric is knitted only with non-excluded needles, hereinafter called active needles, with which a first part 3 made of partial courses and of constant width is manufactured (FIG. 6*a*). Advantageously this part of constant width is made with a number of needles greater than half the total cylinder needles, so giving greater width to the panty portion. The part 3 consists of partial rows and comprises a selvedge 13*a* on its two edges. The selvedges originate because of the reciprocatory motion of the needle cylinder, which causes the end needles of the group of active needles to respectively form the last stitch of one course and subsequently the first stitch of the following course as the needle cylinder inverts its sense of movement. During this operation no other needles are excluded, and the entire part 3 is constructed with the same number of needles for a predetermined height, variable at will.

Figure 6B:
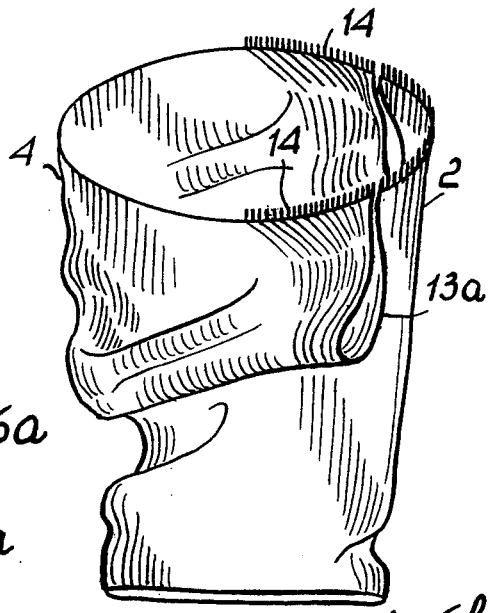
Figure 6C:
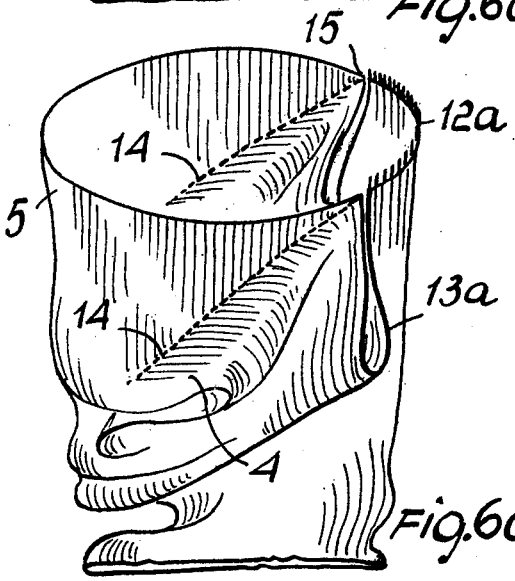

On reaching the partial row 13, and continuing with reciprocating motion, the active needles are progressively reduced, while the excluded needles of the arc 12*a* remain excluded and hold the knitwork (FIG. 6*b*). The progressively inactivated needles, for example one at each end of the group of active needles for each reciprocation of the needle cylinder, hold the knitwork along the lines 14, while the active remaining needles produce the narrowing part 4 on the front and back. At a certain point, when the reduction has reached the required degree, the progressively inactivated needles are again progressively returned into operation starting with those last excluded, until the number of active needles used to knit the part 3 has been attained. This occurs at the partial row 15, when the widening part 5 has been completed (FIG. 6*c*). At this point exactly one half of the panty hose has been knitted and manufacture of parts 6 to 10 begins in a manner analogous to that described for the corresponding parts 1 to 5.

Figure 6D:
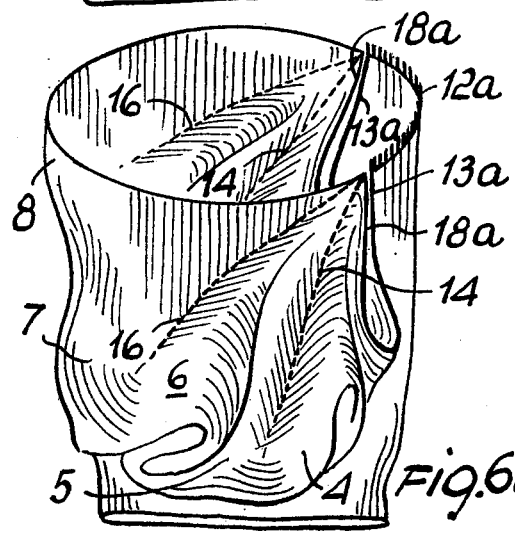

Part 6 is obtained by progressive reduction as in the case of part 4, while part 7 is obtained by progressive increase as in the case of part 5, the parts remaining connected on the lines 16. When the partial row 17 has been reached, still using reciprocating cylinder motion, a second part 8 made of partial courses of constant width corresponding to part 3 is made, with the same needles used for part 3, while the needles on line 12*a* are still out of operation (FIG. 6*d*). The part 8 comprises a selvedge 18*a* on its two edges and is made with a constant number of working needles for a height corresponding to the height of the part 3.

Figure 6E:
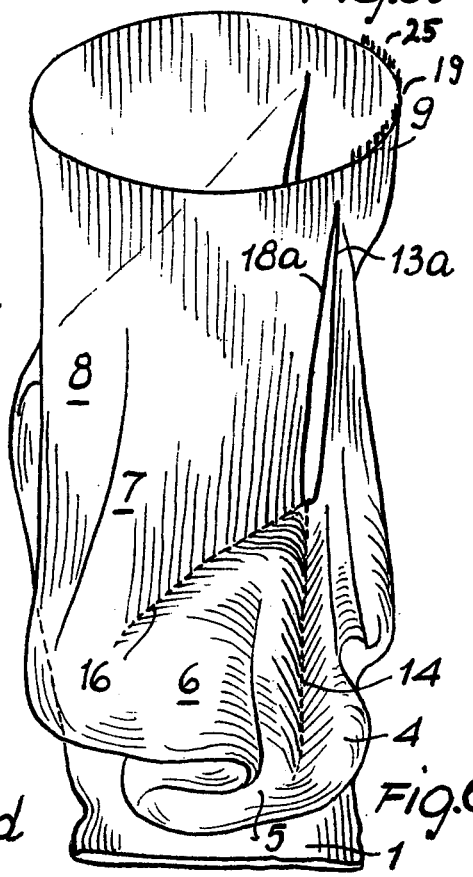

On reaching the partial row 18, the excluded needles on the line 12*a* are simultaneously returned to operation and the needle cylinder is again driven with continuous rotary motion, to make the tubular part 9 with all needles FIG. 6*e*. The needles which formed the part 12*a* of the last complete course of portion 2 therefore add to the needles which have formed the panty portion and complete courses are formed, thus joining portion 2 to portion 9 along line 12*a*. The loops along line 12*a* become arranged in a vertical plane on the finished fabric since they pertain both to portion 2 and to portion 9, completing the last complete course of portion 2 and the first complete course of portion 9. Portion 9 is knitted like portion 2 and, on reaching row 19, the second leg portion 10 is knitted, using the same thread, type of stitch or colour used for the portions 2 and 1 respectively.

Figure 3:
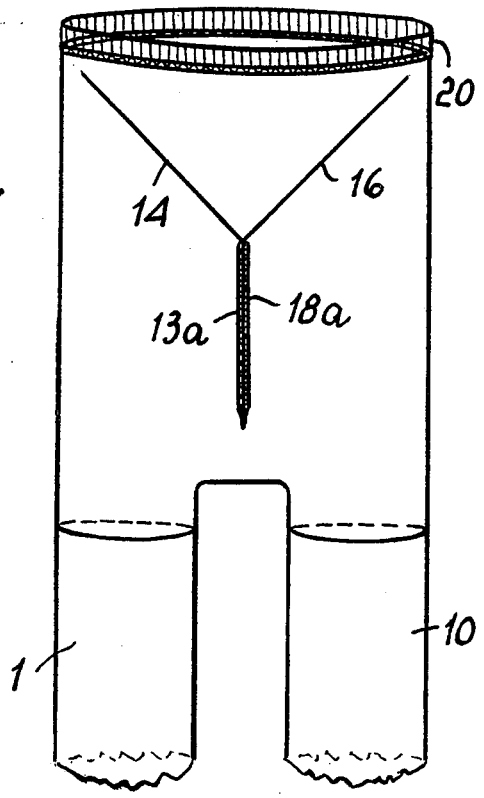
FIG. 3 shows the finished panty hose.

The panty hose produced in this manner is then discharged from the machine and is cut in its upper central portion 5, 6 to define the waist opening, an elastic belt or the like, 20, being sewn on the edge of the aperture as shown in FIG. 3. The selvedges 13*a* and 18*a* are then sewn to close the stocking, which assumes the appearance shown diagrammatically in FIG. 3. As can be seen, the sewing is limited to a small part of the height of the panty portion and is made on straight parts, held together at their ends. As the portions 3 and 8 may be manufactured for any desired height, the panty portion may be elongated to any desired degree, which it is not possible to do when the portion 2 is followed directly by the portion 4 and the portion 7 by the portion 9, as with known methods.

FIG. 6, namely parts 6*a*–6*e*, shows the configuration of the downwardly-extending fabric tube as it hangs from the needle cylinder during knitting of sections 3–8 as shown in FIG. 1. FIG. 6*a* shows the needles 25 corresponding to the arc 12*a* excluded from operation; see also FIG. 4. These remain excluded holding the fabric throughout succeeding operations leaving the selvege 13*a* and 18*a* as the progressive knitting of the portions shown in FIG. 6*e*, which shows all of the excluded needles returned to the normal operating position for the row 19.

For carrying out the described method, a circular knitting machine is proposed which is particularly provided for the correct manufacture of the panty portion over the part lying between the inactivation of the needles on line 12*a* and their return to operation. In this respect, while knitting this part the drawing of the fabric downwards (or upwards in the case of machines taking-up the fabric upwards) must be interrupted, otherwise the fabric would be torn on the line 12*a* where it is held by the needles. However, the production of knitted fabric with the remaining active needles must proceed regularly, this fabric having to be under regular tension for the formation of regular stitches.

To attain this, the invention proposes a circular knitting machine which besides having means for reciprocating the needle cylinder or needle cylinders and means for selecting the needles in order to produce a simultaneous and a progressive inactivation of some needles and their simultaneous and progressive return to operation, also includes suction means for the fabric and an element for closing the passage of the fabric through the needle cylinder or needle cylinders, this closing element being configured to operate simultaneously with the operation of the suction means.

The example shown considers the case of a double cylinder circular knitting machine, with an upper needle cylinder 21 and a lower needle cylinder 22, in the slots 23 and 24 of which slide double hooked needles 25. Inside the lower needle cylinder 22 through which the fabric 26 is discharged, a fabric guide tube 27 is arranged rigid with the needle cylinder 22. FIG. 4 shows the condition on beginning the part 3, where part of the needles (left needle in FIG. 4) holds the fabric along the line 12*a* and another part of the needles (right needle in FIG. 4) is in operation.

A duct 28 connected to suction means, not shown, opens into the guide tube 27, and under the duct 28, at the end of the tube 27, there is fixed a closing element in the form of a flexible tubular element 29 secured to the guide tube 27, for example by a clip, not shown. The flexible tubular element 29 is arranged at a distance from the needle working zone not greater than the length of a leg of the panty hose to be produced. The height of the flexible tubular element 29 is limited, and in particular it is slightly greater than the diameter of the element, as shown in the figure.

Below the tubular element 29 are disposed conventional fabric tensioning and discharge means, for example two rollers which engage the fabric to give it the necessary tension during the working stage on all needles.

Figure 5:
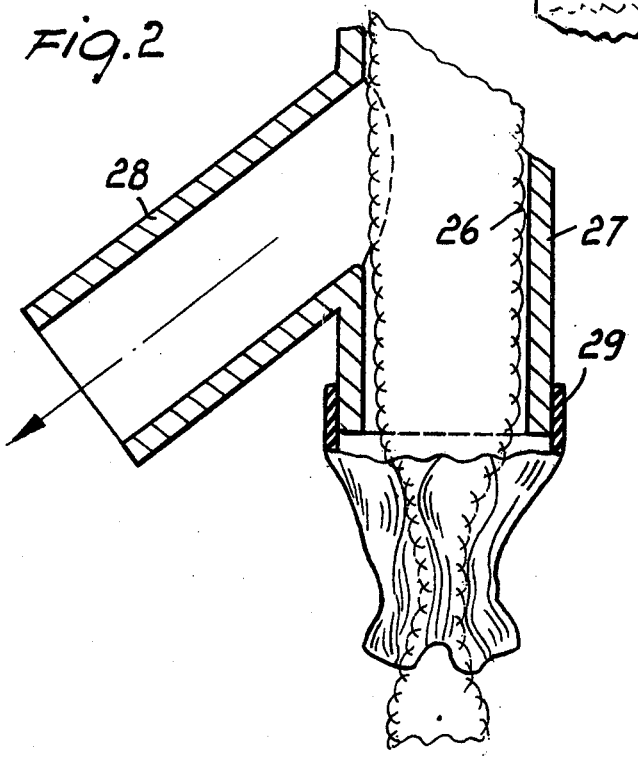
FIG. 5 is a partial section through the lower end of the fabric guide and discharge tube and the flexible tubular element, during manufacture of the panty portion.

The drawing action of the tensioning rollers under the cylinder 22 is suspended during the whole period of manufacture of the panty portion between the portions 3 to 8 inclusive, while suction through the duct 28 is effected. This also causes a sucking action on the lower part of the guide tube 27, which makes the flexible tubular element 29 squeeze the fabric as shown in FIG. 5, thus closing the guide at the bottom and generating a more effective suction action in the region above the duct 28, where the fabric being formed by the active needles has to be drawn. The flexible tubular element 29, clamped about the knitted fabric, does not damage it and in addition guarantees effective closure action without the use of complicated mechanical means. The tubular element 29 is constructed of a material sufficiently elastic and/or of such a thickness as to allow the element to easily wrap itself about the fabric.

The suction action is suspended on finishing part 8 of the panty portion, when all needles return to operation, so that the flexible tubular element 29 instantaneously returns to its initial open position, and the tensioning rollers are again driven.

A double cylinder circular knitting machine has been considered to emphasize the fact that the panty hose according to the invention may be manufactured, at least partly, with the varieties of stitch obtainable on a machine of this type. Obviously the invention is also applicable to a single cylinder knitting machine. The suction and closure device may be disposed in the upper needle cylinder when the fabric is taken-up through the upper needle cylinder. The panty hose considered is a long legged panty hose, but the invention is not limited to this type of article, it being possible to obtain an article limited for example to the portions from 2 to 9 inclusive using the same method.

I claim:

1. A method for manufacturing panty hose or like fabrics on a circular knitting machine having at least one needle cylinder, comprising knitting a first leg portion with continuous rotary motion of said at least one cylinder and with all the needles operating, simultaneously inactivating a certain number of needles and causing them to hold the fabric on termination of said leg portion, knitting with the remaining needles by reciprocating said at least one needle cylinder a first part of constant width consisting of a number of partial courses defining a selvedge at their ends, progressively reducing the operating needles by progressively inactivating needles on the two sides of the group of operating needles and causing said progressively inactivated needles to hold the fabric, progressively increasing the operating needles by progressively activating said progressively inactivated needles until the same number of operating needles has been attained as during the knitting of said first part, further progressively reducing and further progressively increasing the operating needles as during said progressively reducing step and said progressively increasing step, knitting a second part of constant width extending substantially over the same number of courses as said first part, simultaneously activating all the needles causing said at least one needle cylinder to pass into continuous rotary motion and knitting a second leg portion with all the needles, cutting the central part of the fabric to define a waist opening, and sewing said two parts of constant width at the selvedges on the two sides over the entire height of said parts.

2. A method as claimed in claim 1, wherein said parts of constant width are knitted with a number of needles greater than one half the total number of cylinder needles.

3. A method as claimed in claim 1, wherein during said progressive reducing steps one needle is inactivated at each end of the group of operating needles for each reciprocation of said at least one needle cylinder, and during said increasing steps one needle is returned to operation at each end of the group of operating needles for each reciprocation of said at least one needle cylinder.

* * * * *